US008079109B2

(12) United States Patent
Misner et al.

(10) Patent No.: US 8,079,109 B2
(45) Date of Patent: Dec. 20, 2011

(54) ILLUMINATED TOOTHBRUSH

(75) Inventors: Chad Misner, Arlington Heights, IL (US); Dennis Eatherton, Barrington, IL (US)

(73) Assignee: Sunstar Americas, Inc., Chicago, IL (US)

( * ) Notice: Subject to any disclaimer, the term of this patent is extended or adjusted under 35 U.S.C. 154(b) by 623 days.

(21) Appl. No.: 12/202,937

(22) Filed: Sep. 2, 2008

(65) Prior Publication Data

US 2010/0050357 A1 Mar. 4, 2010

(51) Int. Cl.
*A46B 15/00* (2006.01)
*A46B 5/00* (2006.01)

(52) U.S. Cl. ..... 15/105; 15/167.1; 15/143.1

(58) Field of Classification Search ..... 15/105, 15/143, 167.1, 143.1; 248/110, 205.5, 108, 248/109, 205.8, 205.9, 206.2, 683; *A46B 5/00, A46B 15/00*

See application file for complete search history.

(56) References Cited

U.S. PATENT DOCUMENTS 4,188,717 A * 2/1980 Mansfield ..... 30/537
4,450,599 A 5/1984 Scheller et al.
4,779,173 A * 10/1988 Carr et al. ..... 362/109
4,780,924 A * 11/1988 Hansen et al. ..... 15/176.1
4,788,734 A 12/1988 Bauer
4,875,147 A * 10/1989 Auer ..... 362/205
5,072,477 A * 12/1991 Pai ..... 15/22.1
5,305,490 A * 4/1994 Lundgren ..... 15/167.1
5,306,151 A * 4/1994 Rauch ..... 433/216
5,339,479 A * 8/1994 Lyman ..... 15/105
5,369,835 A * 12/1994 Clarke ..... 15/167.1
5,371,915 A * 12/1994 Key ..... 15/167.1
5,372,501 A * 12/1994 Shalvi ..... 433/32
5,438,726 A 8/1995 Leite
5,517,713 A * 5/1996 Hadcock ..... 15/167.1
5,673,451 A 10/1997 Moore et al.
5,742,971 A * 4/1998 Salinger ..... 15/167.1
5,813,855 A * 9/1998 Crisio, Jr. ..... 433/29
5,827,064 A * 10/1998 Bock ..... 433/216
5,836,033 A * 11/1998 Berge ..... 15/110
5,875,510 A * 3/1999 Lamond et al. ..... 15/167.1
5,896,614 A * 4/1999 Flewitt ..... 15/167.1
5,898,967 A * 5/1999 Wu et al. ..... 15/167.1
5,908,038 A * 6/1999 Bennett ..... 132/308
5,943,723 A * 8/1999 Hilfinger et al. ..... 15/22.1
5,946,758 A * 9/1999 Hohlbein et al. ..... 15/167.1
5,946,759 A * 9/1999 Cann ..... 15/167.1
5,960,507 A * 10/1999 Dutra et al. ..... 15/105
5,966,769 A * 10/1999 Tortorice ..... 15/105
6,006,394 A * 12/1999 Bredall et al. ..... 15/167.1
6,029,303 A * 2/2000 Dewan ..... 15/105
6,029,304 A 2/2000 Hulke et al.
6,065,176 A * 5/2000 Watanabe et al. ..... 15/167.1
6,074,076 A * 6/2000 Parrish-Bhagwat ..... 362/253
6,076,223 A * 6/2000 Dair et al. ..... 15/167.1
6,081,957 A * 7/2000 Webb ..... 15/105
6,088,869 A * 7/2000 Kaneda et al. ..... 15/167.1
6,106,294 A * 8/2000 Daniel ..... 433/216

(Continued)

*Primary Examiner* — Monica Carter
*Assistant Examiner* — Michael Jennings
(74) *Attorney, Agent, or Firm* — Michael Best & Friedrich LLP

(57) ABSTRACT

The invention provides a toothbrush having a handle portion defining a longitudinal axis, a head portion coupled to the handle portion having a plurality of bristles extending therefrom, a light source disposed within at least one of the handle portion and the head portion, and a base portion including a suction cup configured to removably adhere to a support surface, wherein the suction cup includes an actuator configured to actuate the light source.

16 Claims, 2 Drawing Sheets

U.S. PATENT DOCUMENTS 6,108,851 A * 8/2000 Bredall et al. ..... 15/167.1
6,178,582 B1 * 1/2001 Halm ..... 15/167.1
6,202,241 B1 * 3/2001 Hassell et al. ..... 15/22.1
6,202,242 B1 * 3/2001 Salmon et al. ..... 15/22.1
6,332,233 B1 * 12/2001 Proulx ..... 15/167.1
6,338,176 B1 * 1/2002 Smith et al. ..... 15/28
6,341,400 B1 * 1/2002 Kobayashi et al. ..... 15/105
6,357,072 B1 * 3/2002 Zinn ..... 15/105
6,367,112 B1 * 4/2002 Moskovich et al. ..... 15/167.1
6,606,755 B1 * 8/2003 Robinson et al. ..... 15/105
6,698,626 B2 * 3/2004 McKay ..... 222/192
6,752,627 B2 * 6/2004 Lin ..... 433/29
6,763,977 B2 * 7/2004 McKay ..... 222/192
6,883,353 B2 * 4/2005 Goldoni et al. ..... 68/5 A
6,895,625 B2 5/2005 Lev et al.
6,944,903 B2 * 9/2005 Gavney, Jr. ..... 15/104.94
6,954,961 B2 * 10/2005 Ferber et al. ..... 15/22.1
6,964,603 B2 * 11/2005 Fischer et al. ..... 451/532
7,080,980 B2 * 7/2006 Klupt ..... 433/80
7,127,769 B2 * 10/2006 Chang et al. ..... 15/105
7,168,122 B1 * 1/2007 Riddell ..... 15/22.1
7,219,486 B1 * 5/2007 Conforth ..... 54/66
7,240,390 B2 * 7/2007 Pfenniger et al. ..... 15/22.1
7,293,318 B1 * 11/2007 Kuo et al. ..... 15/167.1
7,418,757 B2 * 9/2008 Gatzerneyer et al. ..... 15/105
7,478,960 B2 * 1/2009 Glover ..... 401/188 R
7,599,506 B2 * 10/2009 Filo et al. ..... 381/151
7,601,655 B2 * 10/2009 Katsin ..... 442/192
7,713,461 B2 * 5/2010 Pfenniger et al. ..... 264/272.21
7,748,072 B2 * 7/2010 Rycroft ..... 15/105
7,793,379 B2 * 9/2010 Weiss ..... 15/167.1
7,841,041 B2 * 11/2010 Moskovich et al. ..... 15/167.1
7,845,042 B2 * 12/2010 Moskovich et al. ..... 15/167.1
7,846,536 B2 * 12/2010 Dubey ..... 428/192
7,882,588 B2 * 2/2011 Dragan et al. ..... 15/106
7,901,115 B2 * 3/2011 Chien ..... 362/397
7,910,795 B2 * 3/2011 Thomas et al. ..... 604/358
2004/0143920 A1 7/2004 Nanda
2006/0037158 A1 2/2006 Foley et al.
2008/0028553 A1 2/2008 Batthauer

* cited by examiner

ILLUMINATED TOOTHBRUSH

BACKGROUND

The present invention relates to a dental cleaning device, such as a toothbrush. More specifically, the present invention relates to an illuminated toothbrush having timed illumination.

Known illuminated toothbrushes typically employ a button or switch on the grip portion of the handle. Actuation of the button or switch begins a timed period of illumination that generally corresponds to a dentist-recommended brushing time period for adequate cleaning of a user's teeth.

SUMMARY

In one embodiment, the invention provides a toothbrush having a handle portion defining a longitudinal axis, a head portion coupled to the handle portion having a plurality of bristles extending therefrom, a light source disposed within at least one of the handle portion and the head portion, and a base portion including a suction cup configured to removably adhere to a support surface, wherein the suction cup includes a button configured to actuate the light source.

Other aspects of the invention will become apparent by consideration of the detailed description and accompanying drawings.

DETAILED DESCRIPTION

It is to be understood that the invention is not limited in its application to the details of construction and the arrangement of components set forth in the following description or illustrated in the following drawings. The invention is capable of other embodiments and of being practiced or of being carried out in various ways.

Figure 1:
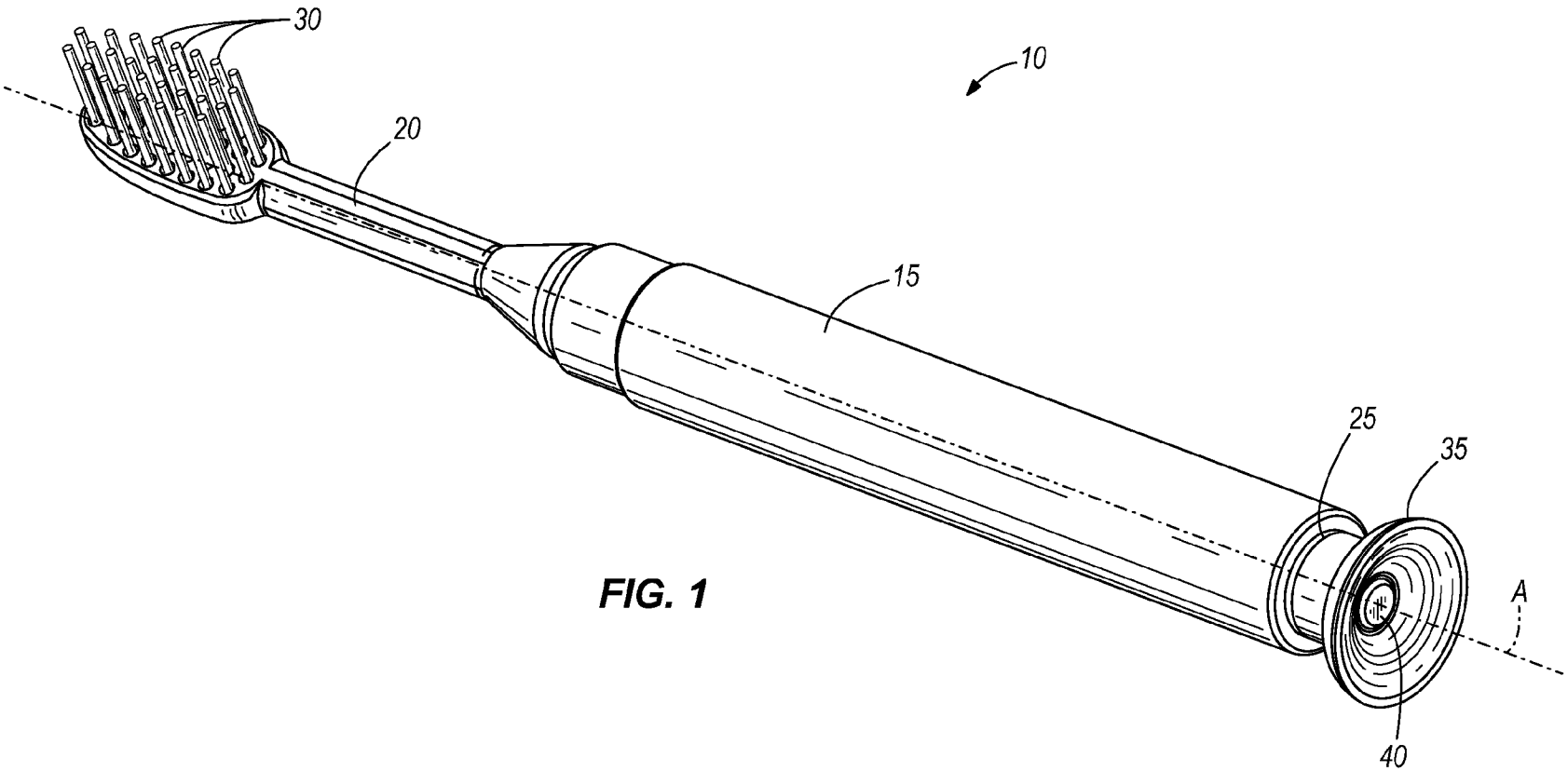
FIG. 1 is a perspective view of a toothbrush in accordance with the present invention.

FIG. 1 illustrates a toothbrush 10 including a handle portion 15 defining a longitudinal axis A, a head portion 20, and a base portion 25. The handle portion 15 includes substantially translucent and/or transparent materials to allow the passage of light therethrough. The head portion 20, which preferably also includes a substantially transparent or translucent material, is coupled to a first end of the handle portion 15 and includes a plurality of bristles 30 extending therefrom. The base portion 25 is coupled to a second end of the handle portion 15 and includes a suction cup 35, which is substantially circular in shape and centered about the longitudinal axis A. The suction cup 35 includes an actuator in the form of a button 40 located in the center of the circular suction cup 35 and oriented for movement along the longitudinal axis A. The suction cup 35 is configured to removably adhere to a support surface (not shown). In the illustrated construction, the suction cup 35 is configured such that the longitudinal axis A of the handle portion 15 is substantially normal to the support surface when the suction cup 35 is adhered to the support surface. In other constructions, the suction cup 35 may be configured to support the toothbrush 10 in other orientations, such as parallel to the support surface.

Figure 2:
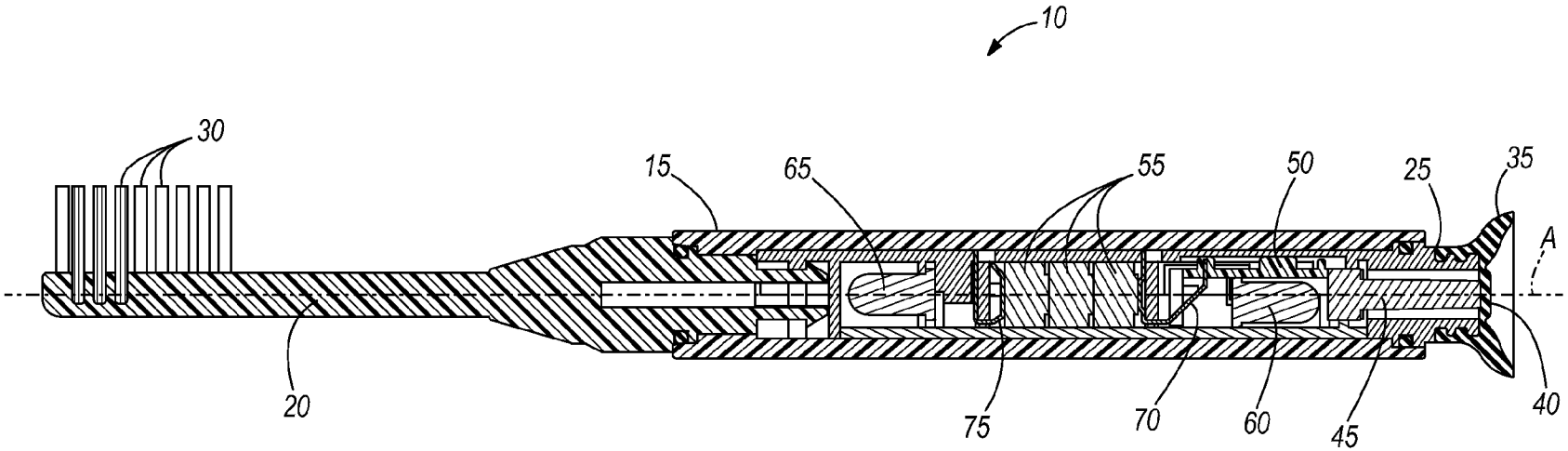
FIG. 2 is a cross sectional view of the toothbrush of FIG. 1.

With reference to FIG. 2, a switch 45 is coupled to the button 40, is moveable with the button 40, and is configured for movement substantially parallel to the longitudinal axis A.

The switch 45 is disposed within the base portion 25 and the handle portion 15 and is coaxial with the longitudinal axis A. It is to be understood that in other constructions, the switch 45 may be configured for movement in other directions, and may not be coaxial with the longitudinal axis A.

A printed circuit board (PCB) 50 is positioned adjacent the switch 45 and is disposed substantially within the handle portion 15. The switch 45 and button 40 are movable between a first position in which the switch 45 contacts the PCB 50, making an electrical connection therewith, and second position in which the switch 45 does not contact the PCB 50 and does not make an electrical connection therewith. The button 40 and the switch 45 are biased toward the second position.

A first light source 60, such as a light-emitting diode (L.E.D.), is electrically connected to the PCB 50 and disposed at a first location within the handle portion 15 adjacent a transparent or translucent portion of the handle 15. A second light source 65, such as a light-emitting diode (L.E.D.), is electrically connected to the PCB 50 and is disposed at a second location within the handle portion 15 adjacent a transparent or translucent portion of the handle 15. In other constructions, one, three or more light sources may be employed. One or more of the light sources may alternatively be disposed within the head portion 20.

A plurality of batteries 55 are disposed adjacent the PCB 50 substantially within the handle portion 15. In the illustrated construction, three AG5 batteries are employed. In other constructions, one or more batteries of any suitable size and power may be employed. A negative battery contact 70 including a wire harness and a positive battery contact 75 including a wire harness are disposed between the PCB 50 and the plurality of batteries 55 to electrically connect the plurality of batteries 55 to the PCB 50.

In operation, the first and second light sources 60, 65 flash on and off for a predetermined time period, such as sixty seconds, when the button 40 is moved to the first position. A timer programmed into the printed circuit board 50 begins counting the predetermined time period upon actuation of the button 40. If the button 40 is moved to the first position while the timer is counting the predetermined time period, the timer starts over and the light sources 60 and 65 continue to flash on and off until the predetermined time period has elapsed. In other constructions, moving the button 40 to the first position while the timer is counting may turn off the light sources. In still other constructions, the light sources may stay illuminated continuously for the predetermined time period, and the predetermined time period may be a different time period.

Thus, the invention provides, among other things, an illuminated toothbrush having a suction cup base in which is disposed a button that activates a light source for a predetermined period of time. Various features and advantages of the invention are set forth in the following claims.

What is claimed is:

1. A toothbrush, comprising:

a handle portion defining a longitudinal axis;

a head portion coupled to the handle portion;

a plurality of bristles extending from the head portion;

a light source disposed within at least one of the handle portion and the head portion; and a base portion including a suction cup configured to removably adhere to a support surface, wherein the suction cup includes an actuator positioned within a substantially circular portion of the suction cup and engageable with the support surface when the suction cup is attached to the support surface, wherein the actuator is moveable between a first position in which the actuator activates the light source and a second position, and wherein the actuator is biased toward the second position.

2. The toothbrush of claim 1, wherein the longitudinal axis is substantially normal to the support surface when the suction cup is adhered to the support surface.

3. The toothbrush of claim 1, wherein the actuator is located on the longitudinal axis.

4. The toothbrush of claim 1, wherein the actuator is located in a center of the substantially circular portion.

5. The toothbrush of claim 1, further comprising a switch coupled to the actuator, wherein the switch is configured for movement substantially parallel to the longitudinal axis.

6. The toothbrush of claim 1, further comprising a printed circuit board and a switch, wherein the switch is coupled to the actuator and moveable with the actuator to contact the printed circuit board when the actuator is moved to the first position, and wherein the printed circuit board operates to illuminate the light source for a predetermined period of time.

7. The toothbrush of claim 6, wherein the switch is biased toward the second position.

8. The toothbrush of claim 6, wherein the printed circuit board includes a timer that begins counting the predetermined period of time when the switch contacts the printed circuit board.

9. The toothbrush of claim 1, wherein the handle portion includes at least one of a substantially transparent material and translucent material, and wherein the light source is disposed adjacent to the at least one of a substantially transparent material and a translucent material.

10. The toothbrush of claim 9, wherein the head portion is substantially transparent.

11. The toothbrush of claim 1, wherein the head portion includes at least one of a substantially transparent material and translucent material, and wherein the light source is disposed adjacent to the at least one of a substantially transparent material and a translucent material.

12. The toothbrush of claim 1, further comprising a second light source disposed within at least one of the handle portion and the head portion.

13. An illuminated toothbrush comprising:

an elongated handle defining a chamber and a longitudinal axis;

a brush head coupled to the handle and including a plurality of bristles;

a suction cup coupled to the handle and having a center portion that defines an actuator, the suction cup releasably attachable to a support surface to support the toothbrush in a position in which the longitudinal axis is substantially normal to the support surface, and the actuator positioned within the suction cup and engageable with the support surface when the suction cup is attached to the support surface;

a switch positioned within the chamber and having an end engaging the actuator, the switch and the actuator moveable together along the longitudinal axis between a first position and a second position and being biased toward the second position; and a light source positioned within the chamber and operating in response to movement of the switch and the actuator along the axis from the second position to the first position.

14. The illuminated toothbrush of claim 13, wherein the light source operates for a predetermined period of time in response to movement of the switch along the axis from the second position to the first position.

15. The illuminated toothbrush of claim 13, further comprising a control circuit having a timer, the control circuit operating in response to movement of the switch along the axis from the second position to the first position to operate the light source.

16. The illuminated toothbrush of claim 15, wherein the control circuit includes a timer for counting a predetermined time period, wherein the timer begins counting the predetermined time period and operates the light source in response to movement of the switch along the axis from the second position to the first position, and wherein the control circuit terminates operation of the light source upon expiration of the predetermined time period.

* * * * *